United States Patent [19]

Reiter et al.

[11] Patent Number: 5,002,231

[45] Date of Patent: Mar. 26, 1991

[54] INJECTION VALVE

[75] Inventors: Ferdinand Reiter, Markgroeningen; Rudolf Krauss, Stuttgart, both of Fed. Rep. of Germany

[73] Assignee: Robert Bosch GmbH, Stuttgart, Fed. Rep. of Germany

[21] Appl. No.: 394,898

[22] Filed: Aug. 17, 1989

[30] Foreign Application Priority Data

Dec. 7, 1988 [DE] Fed. Rep. of Germany ..... 3841142

[51] Int. Cl.[5] ..... F02M 51/00

[52] U.S. Cl. ..... 239/585

[58] Field of Search ..... 239/596, 585, 533.12, 239/492; 251/129.15, 129.21

[56] References Cited

U.S. PATENT DOCUMENTS

| | | | |
|---|---|---|---|
| 2,563,152 | 8/1951 | Brandt | 239/596 |
| 4,494,701 | 1/1985 | Hensley et al. | 239/585 |
| 4,597,558 | 7/1986 | Hafner et al. | 239/585 |
| 4,621,772 | 11/1986 | Blythe et al. | 239/585 |
| 4,648,559 | 3/1987 | Fuller | 239/585 |
| 4,662,567 | 5/1987 | Knapp | 239/585 |
| 4,732,327 | 3/1988 | Aichele et al. | 239/585 X |
| 4,830,286 | 5/1989 | Asslaender et al. | 239/585 |

*Primary Examiner*—Andres Kashnikow
*Assistant Examiner*—Kevin Weldon
*Attorney, Agent, or Firm*—Edwin E. Greigg

[57] ABSTRACT

In a known injection valve having a movable valve element and a valve seat face located in a nozzle body, a cup-shaped injection port insert is provided downstream of the valve seat face. In the novel injection valve, the object is to avoid warping of the injection port insert and to adapt the idle volume to requirements. To increase the rigidity of the injection port insert, the bottom of the injection port insert has a dishlike indentation, which is remote from the movable valve element, so that a collecting chamber is formed between the movable valve element and the bottom. The injection valve is particularly suitable for fuel injection systems in internal combustion engines.

14 Claims, 2 Drawing Sheets

INJECTION VALVE

BACKGROUND OF THE INVENTION

The invention is based on an injection valve as defined herein for combustion engines.

An injection valve of this kind is known from U.S. Pat. No. 4,732,327. A ball is used as the movable valve element in this valve, but it is also known to provide the movable valve element with a toroidal surface, as in German Offenlegungsschrift 3 710 467, or to embody it as a flattened ball, as in U.S. Pat. No. 4,621,772. In German Offenlegungsschrift 3 710 467, the collecting chamber disposed downstream of the valve seat is closed off with a flat plate having bores. This has the disadvantage that the internal pressure may warp the flat plate, so the volume of the collecting chamber may vary under some circumstances. In U.S. Pat. No. 4,621,772, the collecting chamber downstream of the valve seat is closed off by a deformed plate, the edge of which has a conical face and the middle of which has a dishlike indentation. In the closed state of the valve, the movable valve element rests almost on the closure plate, and when the valve opens the medium flowing through the valve must change its direction of flow and is guided along the conical face; the danger exists that the medium may accumulate in the middle chamber defined by the dishlike indentation, and may be very difficult to remove. This plate is also fastened on its edges at right angles to the longitudinal axis of the injection valve, so that once again the internal pressure may cause warping.

OBJECT AND SUMMARY OF THE INVENTION

The injection valve according to the invention and having the characteristics of the body of the main claim has an advantage over the prior art that the injection port insert is cup-shaped and is inserted into a receiving bore, and only the bottom of this cup-shaped injection port insert is provided with a dishlike indentation. As a result, the injection port insert itself cannot be warped, because the dishlike indentation lends it greater rigidity. Also, it is no longer necessary to grind down a movable valve element, embodied for example as a ball or ellipsoid, in order to reduce the idle volume. The idle volume can be adapted as required by suitably deforming the dishlike indentation.

It is also particularly favorable for the valve seat face and the wall of the dishlike indentation to be embodied such that the flow cross section increases steadily in the flow direction, from the valve seat as far as the injection conduits located in the dishlike indentation. As a result, any influence on the fuel metering, which takes place at the valve seat on the one hand and at the injection conduits on the other, is avoided, so that a large pressure drop, which also assures very good fuel preparation, is available at the injection conduits.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 2:
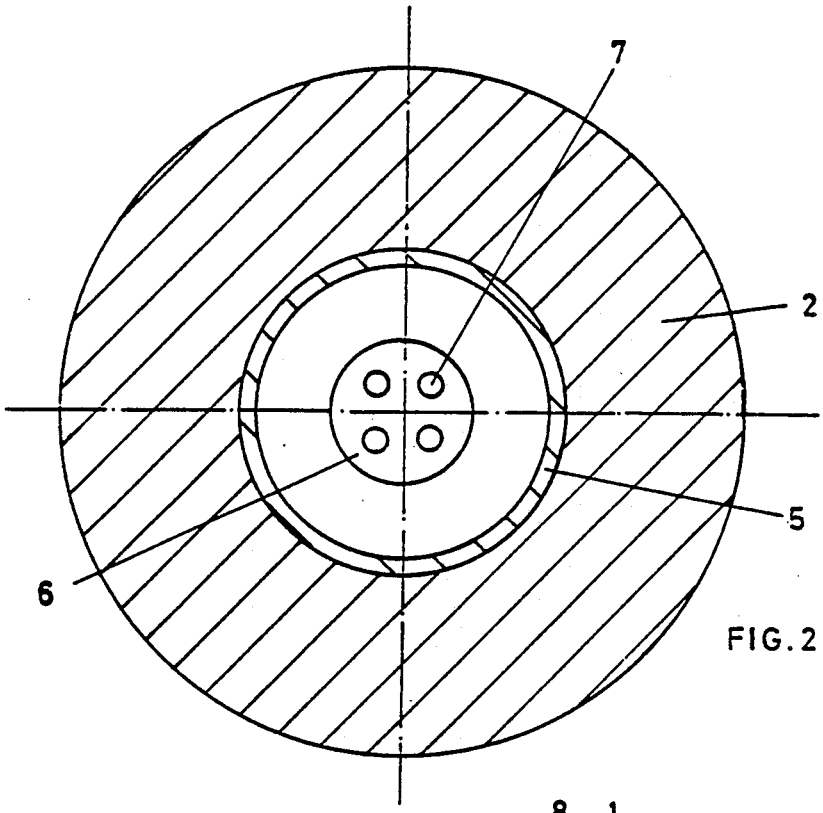
FIG. 2 is a section taken along the line II—II of FIG. 1.

A corresponding injection valve is shown and described in U.S. Pat. No. 4,732,327, which is hereby expressly incorporated by reference. This fuel injection valve is electromagnetically actuatable in a known manner and serves for instance to inject fuel, in particular at low pressure, into the air intake tube of mixture-compressing internal combustion engines having externally supplied ignition. The fuel injection through the fuel injection valve can either take place into the air intake tube upstream or downstream of a throttle valve simultaneously for all the cylinders of the engine, or through a separate fuel injection valve for each cylinder of the engine into the individual air intake tubes immediately upstream of each inlet valve.

The present fuel injection valve has a movable valve element 1, embodied for instance spherically, and cooperates with a correspondingly shaped, in this case conical, fixed valve seat face 3 in a nozzle body 2 that is connected to a valve housing 15. When the electromagnet is not excited, the movable valve element 1 rests on a valve seat 16 of the valve seat face 3, and when the electromagnet of the fuel injection valve is excited it is lifted from the valve seat 16, so that fuel can flow in between the movable valve element 1 and the valve seat 16 to reach a collecting chamber 13 of minimum volume. The valve seat face 3 ends in the collecting chamber 13 at a stop face 17 that extends outward. A receiving bore 4 also embodied in the nozzle body 2 originates at the stop face 17. A cup-shaped injection port insert 5 having a bottom 6 and a cylindrical wall 18 is forced into the receiving bore 4 and joined tightly to the nozzle body 2 by soldering or welding. The cylindrical wall 18 of the injection port insert 5 defines a preparation bore 9, into which the fluid medium emerging from the valve flows via the at least one injection conduit 7 provided in the bottom 5 of the injection port insert 5; this at least one injection conduit 7 may extend parallel to the longitudinal axis 8 of the injection valve, or may be inclined, to generate a swirl.

An exemplary embodiment is shown in FIG. 2 in which four injection conduits 7, for instance being spaced equidistantly apart from one another, are provided in the bottom 6 of the injection port insert 5. The spacing of the injection conduits 7 may be unequal instead, however, in order to attain a desired injection pattern. The injection port insert 5 is preferably manufactured from sheet metal with a wall thickness of approximately 0.1 to 0.5 mm, for example by means of deep drawing.

Figure 3:
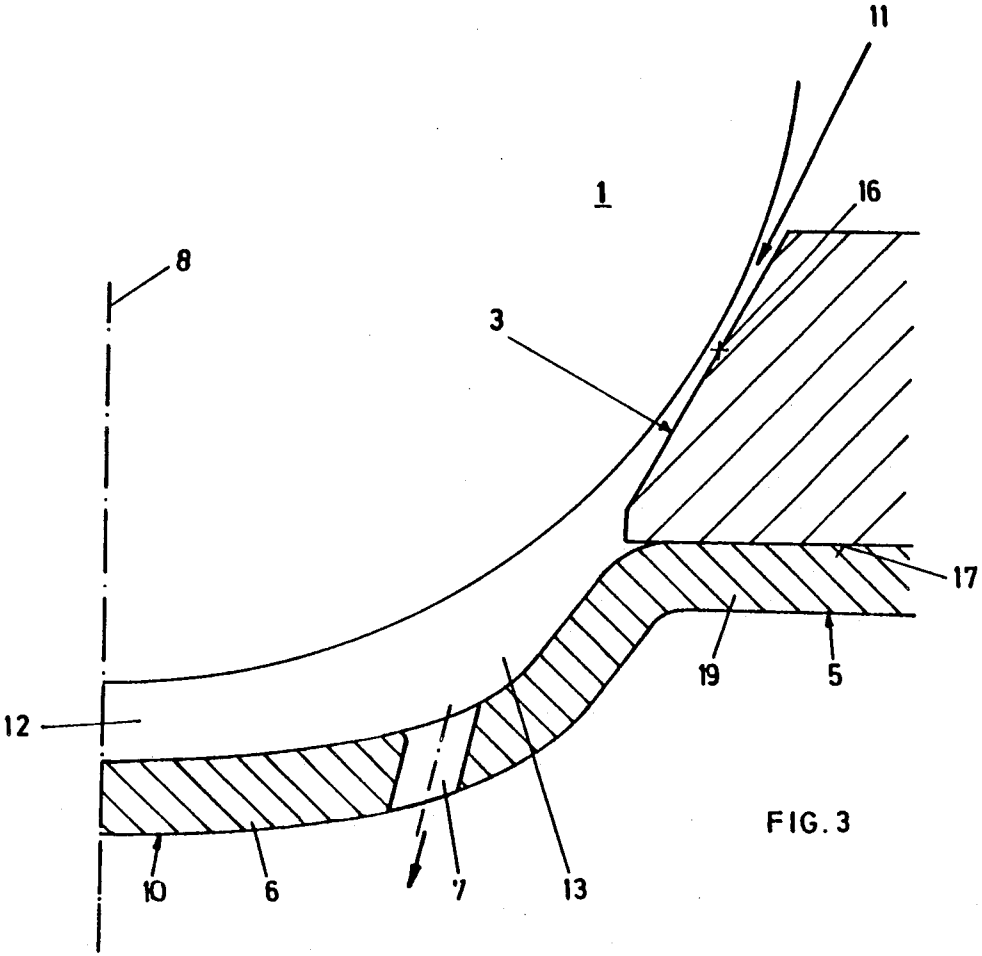
FIG. 3, on a different scale, shows the transition from the valve seat to the dishlike indentation.

FIG. 3 shows that the valve seat face 3 of the nozzle body 2 extends approximately in the form of the internal contour of a dishlike indentation 10 of the bottom 6 between a flat annular region 19 and the injection conduit of the injection port insert 5; that is, these faces merge with one another. The geometry of the valve seat face 3 and of the dishlike indentation 10 of the bottom 6 of the injection port insert 5 is designed such that without, any deflection of the flow, the flow cross section from the valve seat 16 increases steadily in the flow direction 11 as far as the injection conduits 7. This increase may either be continuous or discontinuous. This provision is intended to prevent influence on the metering, which takes place partly at the valve seat 3 and partly at the injection conduits 7. In that case, a large pressure drop is available at the injection conduits 7 for fuel preparation. Moreover, an extremely streamlined inflow of the fuel is obtained, and the idle volume 12 can be kept very small in the collecting chamber 13.

Figure 1:
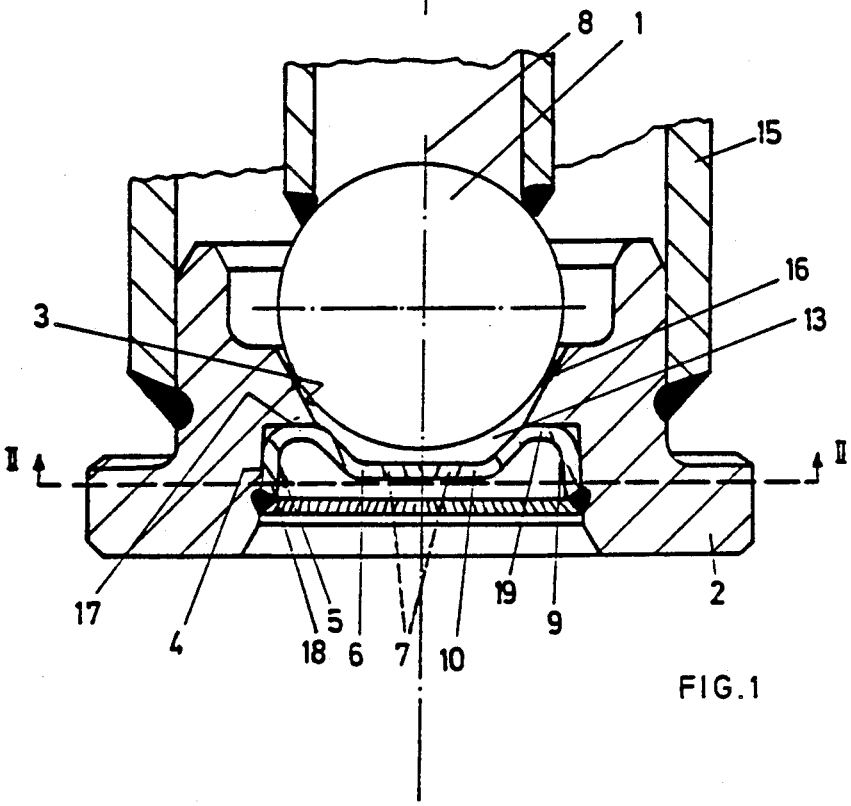
FIG. 1 is a fragmentary section taken through an injection valve having an injection port insert according to the invention.

Beginning at the cylindrical wall 18, the bottom 6 of the injection port insert 5 has a flat annular region 19, which when the insert is forced in comes to rest on the stop face 17, and the dishlike indentation 10 then merges with this annular region toward its middle. The stop face 17 thus determines the position of the injection port insert 5 in the nozzle body 2. The welding or soldering of the injection port insert 5 tightly to the nozzle body 2 may be done either at the lower end of the cylindrical wall 18, as shown in FIG. 1, or between the annular region 19 and the stop face 17.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An injection valve for fuel injection systems of internal combustion engines, having a movable valve element (1) which cooperates with a valve seat (16) provided on a fixed valve seat face (3) of a nozzle body (2), downstream of the valve seat face (3) said nozzle body (2) has a receiving bore (4), a cup-shaped injection port insert (5) including a cylindrical wall (18) and a bottom (6) inserted into said receiving bore, a preparation bore (9) formed by said cylindrical wall (18) of said cup-shaped injection port insert (5), the bottom (6) of said injection port insert is provided with at least one injection conduit (7), said at least one injection conduit discharges into said preparation bore (9) formed by said cylindrical wall (18) of the cup-shaped injection port insert (5), said bottom (6) of said injection port insert (5) has a central dishlike indentation (10) which is remote from said movable valve element (1), so that a collecting chamber (13) is formed between the movable valve element (1) and the bottom (6) of said injection port insert, said valve seat face (3) and a wall portion of said dishlike indentation (10) are embodied such that a flow cross section between the valve element (1) and both the valve seat face (3) and said wall portion of the dishlike indentation (10) increases continuously in the flow direction (11) from the valve seat (16) as far as the at least one flow conduit (7).

2. An injection valve as defined by claim 1, in which said bottom (6) of the injection port insert (5), beginning at the cylindrical wall (18), has a flat annular region (19), said dishlike indentation adjoins said flat annular region (19), and said dishlike indentation (10) includes a wall portion that extends from said flat annular region (19) to said at least one conduit.

3. An injection valve as defined by claim 2, which includes a stop face (17) extending outward to the nozzle body (2) between said valve seat face (3) and said receiving bore (4).

4. An injection valve as defined by claim 1, which includes a stop face (17) extending outward in the nozzle body (2) between said valve seat face (3) and said receiving bore (4).

5. An injection valve for fuel injection systems of internal combustion engines, having a movable valve element (1) which cooperates with a valve seat (16) provided on a fixed valve seat face (3) of a nozzle body (2), downstream of the valve seat face (3) said nozzle body (2) has a receiving bore (4), a cup-shaped injection port insert (5) including a cylindrical wall (18) and a bottom (6) inserted into said receiving bore, a preparation bore (9) formed by said cylindrical wall (18) of said cup-shaped injection port insert (5), the bottom (6) of said injection port insert is provided with at least one injection conduit (7), said at least one injection conduit discharges into said preparation bore (9) formed by said cylindrical wall (18) of the cup-shaped injection port insert (5), said bottom (6) of said injection port insert (5) has a central dishlike indentation (10) which is remote from said movable valve element (1) in which a wall of the dishlike indentation (10) approximately extends said fixed valve seat face (3) in a flow direction (11) so that a collecting chamber (13) is formed between the movable valve element (1) and the bottom (6) of said injection port insert, said valve seat face (3 and a wall portion of said dishlike indentation (10) are embodied such that a flow valve seat face (3) and said wall portion of the dishlike indentation (10) increases continuously in the flow direction (11) from the valve seat (16) as far as the at least one flow conduit (7).

6. An injection valve as defined by claim 5, in which said bottom (6) of the injection port insert (5), beginning at the cylindrical wall (18), has a flat annular region (19), said dishlike indentation adjoins said flat annular region (19), and said dishlike indentation (10) includes a wall portion that extends from said flat annular region (19) to said at least one conduit.

7. An injection valve as defined by claim 6, which includes a stop face (17) extending outward in the nozzle body (2) between said valve seat face (3) and said receiving bore (4).

8. An injection valve as defined by claim 5, which includes a stop face (17) extending outward in the nozzle body (2) between said valve seat face (3) and said receiving bore (4).

9. An injection valve for fuel injection systems of internal combustion engines, having a movable valve element (1) which cooperates with a valve seat (16) provided on a fixed valve sat face (3) of a nozzle body (2), downstream of the valve seat face (3) said nozzle body (2) has a receiving bore (4), a cup-shaped injection port insert (5) including a cylindrical wall (18) and a bottom (6) inserted into said receiving bore, a preparation bore (9) formed by said cylindrical wall (18) of said cup-shaped injection port insert (5), the bottom (6) of said injection port insert is provided with at least one injection conduit (7), said at least one injection conduit discharges into said preparation bore (9) formed by said cylindrical wall (18) of the cup-shaped injection port insert (5), said bottom (6) of said injection port insert (5) has a central dishlike indentation (10) which is remote from said movable valve element (1) so that a collecting chamber (13) is formed between the movable valve element (1) and the bottom (6) of said injection port insert and said bottom (6) of the injection port insert (5), beginning at the cylindrical wall (18), has a flat annular region (19), said dishlike indentation adjoins said flat annular region (19) and said dishlike indentation (10) includes a wall portion that extends from said flat annular region (19) to said at least one conduit.

10. An injection valve as defined by claim 9, which includes a stop face (17) extending outward in the nozzle body (2) between said valve seat face (3) and said receiving bore (4).

11. An injection valve for fuel injection systems of internal combustion engines, having a movable valve element (1), which cooperates with a valve seat (16) provided on a fixed valve seat face (3) of a nozzle body (2), downstream of the valve seat face (3), said nozzle body (2) has a receiving bore (4), a cup-shaped injection port insert (5) inserted into said receiving bore, said cup-shaped injection port insert including a cylindrical wall (18) and a bottom (6), a preparation bore (9) formed by said cylindrical wall (18) of said cup-shaped injection port insert (5), the bottom (6) of said injection port insert beginning at the cylindrical wall (18), has a flat annular region (19), and is provided with at least one injection conduit (7), said at least one injection conduit discharges into said preparation bore (9) formed by said cylindrical wall (18) of the cup-shaped injection port insert (5), said bottom (6) of said injection port insert (5) has a central dishlike indentation (10) which is remote from said movable valve element (1), so that a collecting chamber (13) is formed between the movable valve element (1) and an upper surface of the bottom (6) of said injection port insert, said dishlike indentation adjoins said flat annular region (19), and said dishlike indentation (10) includes a wall portion that extends from said flat annular region (19) to said at least one conduit, and a wall of the dishlike indentation (10) approximately extends said fixed valve seat face (3) in the flow direction (11).

12. An injection valve as defined by claim 10, which includes a stop face (17) extending outward in the nozzle body (2) between said valve seat face (3) and said receiving bore (4).

13. An injection valve for fuel injection systems of internal combustion engines, having a movable valve element (1), which cooperates with a valve seat (16) provided on a fixed valve seat face (3) of a nozzle body (2), downstream of the valve seat face (3), said nozzle body (2) has a receiving bore (4), a stop face (17) extending outward in the nozzle body (2) between said valve seat face (3) an said receiving bore (4), a cup-shaped injection port insert (5) inserted into said receiving bore, said cup-shaped injection port insert including a cylindrical wall (18) and a bottom (6), a preparation bore (9) formed by said cylindrical wall (18) of said cup-shaped injection port insert (5), the bottom (6) of said injection port insert is provided with at least one injection conduit (7), said at least one injection conduit discharges into said preparation bore (9) formed by said cylindrical wall (18) of the cup-shaped injection port (5), said bottom (6) of said injection port insert (5) has a central dishlike indentation (10) which is remote from said movable valve element (1), so that a collecting chamber (13) is formed between the movable valve element (1) and an upper surface of the bottom (6) of said injection port insert.

14. An injection valve for fuel injection systems of internal combustion engines, having a movable valve element (1), which cooperates with a valve seat (16) provided on a fixed valve seat face (3) of a nozzle body (2), downstream of the valve seat face (3), said nozzle body (2) has a receiving bore (4), a stop face (17) extending outward in the nozzle body (2) between said valve seat face (3) and said receiving bore (4), a cup-shaped injection port insert (5) inserted into said receiving bore, said cup-shaped injection port insert including a cylindrical wall (18) and a bottom (6), a preparation bore (9) formed by said cylindrical wall (18) of said cup-shaped injection port insert (5), the bottom (6) of said injection port insert is provided with at least one injection conduit (7), said at least one injection conduit discharges into said preparation bore (9) formed by said cylindrical wall (18) of the cup-shaped injection port insert (5), said bottom (6) of said injection port insert (5) has a central dishlike indentation (10) which is remote from said movable valve element (1), so that a collecting chamber (13) is formed between the movable valve element (1) and an upper surface of the bottom (6) of said injection port insert, and a wall of the dishlike indentation (10) approximately extends said fixed valve seat face (3) in the flow direction (11).

* * * * *